US010582574B2

(12) United States Patent
Ok et al.

(10) Patent No.: US 10,582,574 B2
(45) Date of Patent: Mar. 3, 2020

(54) INDUCTION HEAT COOKING APPARATUS AND METHOD FOR DRIVING THE SAME

(71) Applicant: LG ELECTRONICS INC., Seoul (KR)

(72) Inventors: Seungbok Ok, Seoul (KR); Dooyong Oh, Daejeon (KR); Oksun Yu, Seoul (KR); Hyunwook Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 668 days.

(21) Appl. No.: 15/048,371

(22) Filed: Feb. 19, 2016

(65) Prior Publication Data

US 2016/0374151 A1 Dec. 22, 2016

(30) Foreign Application Priority Data

Jun. 22, 2015 (KR) ..... 10-2015-0088602

(51) Int. Cl.
*H05B 6/06* (2006.01)
*H05B 1/02* (2006.01)
*H05B 6/12* (2006.01)

(52) U.S. Cl.
CPC ..... *H05B 6/065* (2013.01); *H05B 1/0202* (2013.01); *H05B 1/0266* (2013.01); *H05B 6/1236* (2013.01)

(58) Field of Classification Search
CPC .... H05B 6/065; H05B 1/0202; H05B 1/0266; H05B 6/1236; H05B 6/062; H05B 2213/06; H05B 6/12; H05B 6/1218; H05B 6/1263
USPC ..... 219/624, 626, 650, 655, 656, 671, 236, 219/240, 255, 395, 398, 412, 419, 448.12, 219/462.1, 620, 632, 660, 661, 662, 664,
(Continued)

(56) References Cited

U.S. PATENT DOCUMENTS 591,904 A 10/1897 Webber
2010/0181306 A1* 7/2010 Gutierrez ..... H02M 3/337 219/660
(Continued)

FOREIGN PATENT DOCUMENTS

EP 2736305 A2 5/2014
EP 3002991 A1 4/2016
(Continued)

OTHER PUBLICATIONS

Nagai, Satoshi, et al, JP2004235032A, Induction Heating Cooker, Aug. 19, 2004, J-PlatPat translation, pertinent.*

*Primary Examiner* — Tu B Hoang
*Assistant Examiner* — Masahiko Muranami
(74) *Attorney, Agent, or Firm* — Dentons US LLP

(57) ABSTRACT

An induction heat cooking apparatus includes a rectifier to rectify an input voltage and to output a DC voltage; a plurality of switching elements to switch the DC voltage output from the rectifier; a plurality of heating coils to heat a cooking container according to an operation of the plurality of switching elements; and a control part to control the plurality of switching elements, wherein the control part controls a time at which a switching element between a heating coil which is operated and a heating coil which is not operated among the plurality of heating coils is opened to be earlier than that of another switching element, such that power is not applied to the heating coil which is not operated.

6 Claims, 10 Drawing Sheets

(58) Field of Classification Search
USPC ..... 219/665; 700/300, 295, 296, 297, 306; 327/427
See application file for complete search history.

(56) References Cited

U.S. PATENT DOCUMENTS

| | | | | |
|---|---|---|---|---|
| 2011/0192835 | A1* | 8/2011 | Lee | H05B 6/065 219/621 |
| 2012/0152935 | A1* | 6/2012 | Kitaizumi | H05B 6/065 219/661 |
| 2012/0248095 | A1* | 10/2012 | Lee | H05B 6/1263 219/620 |
| 2013/0334212 | A1* | 12/2013 | Sawada | H05B 6/065 219/662 |
| 2014/0144902 | A1* | 5/2014 | Oh | H05B 6/065 219/620 |
| 2014/0183182 | A1* | 7/2014 | Oh | H05B 6/062 219/662 |

FOREIGN PATENT DOCUMENTS

| | | | | |
|---|---|---|---|---|
| EP | 3002992 | A1 | 4/2016 | |
| JP | 2004235032 | A * | 8/2004 | H05B 6/12 |

* cited by examiner

INDUCTION HEAT COOKING APPARATUS AND METHOD FOR DRIVING THE SAME

CROSS-REFERENCE TO RELATED APPLICATION(S)

This application claims priority under 35 U.S.C. § 119 and 35 U.S.C. § 365 to Korean Patent Application No. 10-2015-0088602, filed in Korea on Jun. 22, 2015, which is incorporated by reference in its entirety for all purposes as if fully set forth herein.

BACKGROUND

Field of the Disclosure

The present invention relates to an electromagnetic induction heat cooking apparatus, and more particularly to an induction heat cooking apparatus which includes a plurality of switching elements and a plurality of resonant circuits, and a method for driving the same.

Background

Generally, an induction heat cooking apparatus is an electric cooking apparatus in which a cooking function is performed in a method in which a high frequency current is caused to flow through a working coil or a heating coil, and an eddy current flows while a strong magnetic line of force generated thereby passes through a cooking container, and thus the cooking container itself is heated.

In the basic heating principle of the induction heat cooking apparatus, as the current is applied to the heating coil, the cooking container formed of a magnetic material generates heat due to induction heating, and the cooking container is heated by the heat it generates to perform cooking.

An inverter used in the induction heat cooking apparatus serves to switch a voltage applied to the heating coil so that the high frequency current flows through the heating coil. The inverter enables the high frequency current to flow through the heating coil by driving a switching element typically including an insulated gate bipolar transistor (IGBT), and thus a high frequency magnetic field is formed at the heating coil.

When two heating coils are provided at the induction heat cooking apparatus, two inverters including four switching elements are required to operate the two heating coils.

FIG. 1 is a view illustrating an induction heat cooking apparatus according to a related art.

FIG. 1 illustrates the induction heat cooking apparatus including two inverters and two heating coils.

Referring to FIG. 1, the induction heat cooking apparatus includes a rectifier 10, a first inverter 20, a second inverter 30, a first heating coil 40, a second heating coil 50, a first resonant capacitor 60 and a second resonant capacitor 70.

Each of the first and second inverters 20 and 30 includes two switching elements which switch input electric power and are connected in series, and the first and second heating coils 40 and 50 driven by an output voltage of the switch elements are connected to each connecting point of the switching elements connected in series. Other sides of the first and second heating coils 40 and 50 are connected to the resonant capacitors 60 and 70.

Driving of the switching elements is performed by a driving part. The switching elements apply a high frequency voltage to each of the heating coils, while being controlled by switching time output from the driving part and thus alternately operated. Since on/off time of each of the switching elements applied from the driving part is controlled with gradual compensation, the voltage supplied to each of the heating coils changes from a low voltage to a high voltage.

However, the induction heat cooking apparatus should include two inverter circuits including four switching elements to operate the two heating coils, and thus a volume of a product increases, and a price of the product also increases.

Further, when the number of heating coils is increased to three or more, a plurality of switching elements are required according to the number of heating coils.

SUMMARY

The present invention is directed to an induction heat cooking apparatus having a plurality of heating coils, which is able to be controlled by a minimum number of switching elements, and a method for controlling the same.

The present invention is also directed to an induction heat cooking apparatus having a plurality of heating coils, in which the plurality of heating coils are able to be driven together by a minimum number of switching elements, and a method for controlling the same.

The present invention is also directed to an induction heat cooking apparatus which is able to reduce a leakage current generated when a switching element is closed (turned on) or opened (turned off), and thus to reduce heat from a heating coil which is not operated, and a method for controlling the same.

According to an aspect of the present invention, there is provided an induction heat cooking apparatus including a plurality of switching elements; a plurality of heating coils configured to heat a cooking container according to an operation of the plurality of switching elements; and a control part configured to control the plurality of switching elements, wherein the control part controls a time at which the switching element disposed between the heating coil which is operated and the heating coil which is not operated is opened to be earlier than that of another switching element, such that power is not applied to the heating coil which is not operated among the plurality of heating coils.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

FIGS. 2 to 10 are views illustrating an induction heat cooking apparatus and a method for controlling the same according to an embodiment of the present invention.

Figure 1:
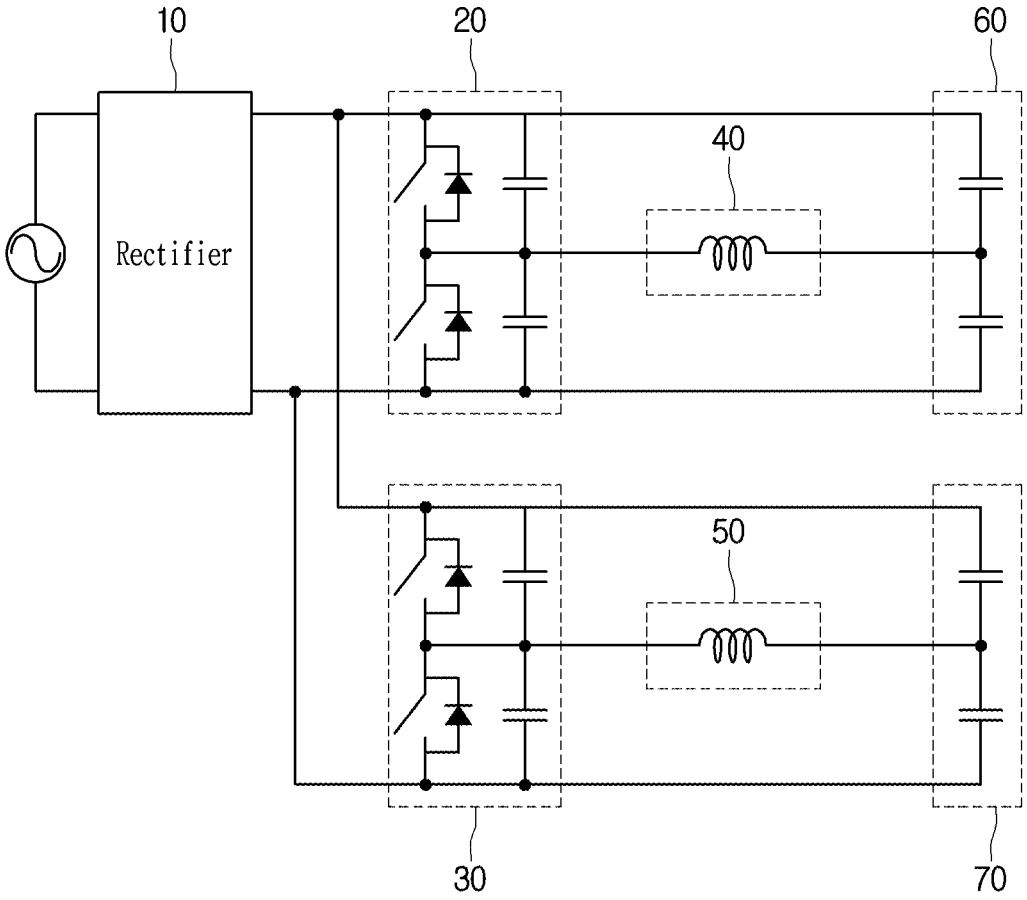
Fig. 1 RELATED ART
FIG. 1 is a view of an induction heat cooking apparatus according to the related art.
Figure 2:
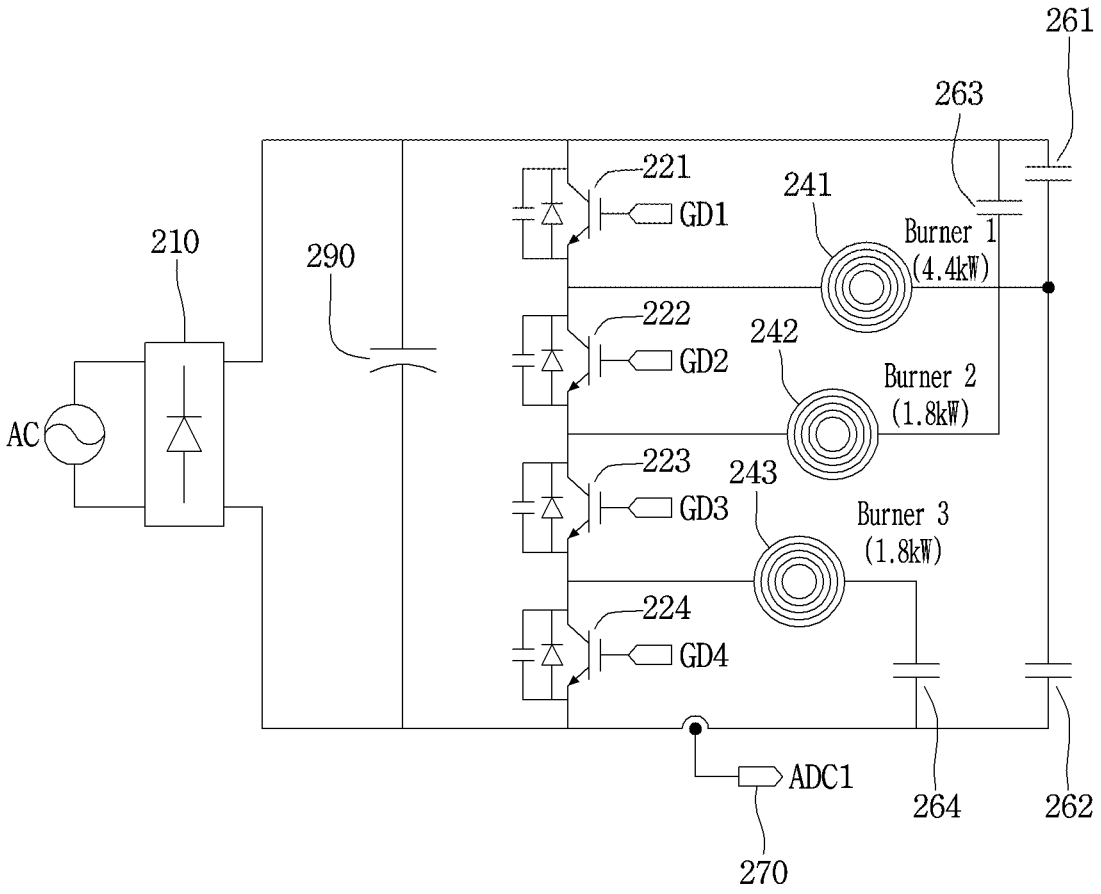
FIG. 2 is a view illustrating a structure of an induction heat cooking apparatus according to an embodiment of the present invention.

FIG. 2 is a view illustrating a structure of an induction heat cooking apparatus according to an embodiment of the present invention.

Referring to FIG. 2, an induction heat cooking apparatus includes a rectifier 210 in which commercial AC power is input from an outside source and the AC power is rectified into DC power, a first switching element 221, a second switching element 222, a third switching element 223, and a fourth switching element 224 which are connected to both ends of a positive power terminal and a negative power terminal of the rectifier 210 and switched according to a control signal. A first heating coil 241 with one end connected to a connecting point is between the first switching element 221 and the second switching element 222, and the other end is connected between a first resonant capacitor 261 and a second resonant capacitor 262, connected to one end, and the other end of the rectifier 210. A second heating coil 242 with one end connected to a connecting point is between the second switching element 222 and the third switching element 223 and the other end is connected to a third resonant capacitor 263 connected to the other end of the rectifier 210. A third heating coil 243 with one end connected to a connecting point is between the third switching element 223 and the fourth switching element 224 and the other end is connected to a fourth resonant capacitor 264 connected to the other end of the rectifier 210.

Also, although not illustrated, a control part which controls switching operations of the switching elements 221, 222, 223, and 224 is further included. The embodiment describes an example in which three heating coils are provided.

In the embodiment, when the number of heating coils is N, N+1 switching elements may be provided, and the heating coils may be driven in a state in which the number of switching elements is minimized.

One end of the first switching element 221 is connected to the positive power terminal, and the other end thereof is connected to the second switching element 222. One end of the second switching element 222 is connected to the first switching element 221 and the other end thereof is connected to the third switching element 223. One end of the third switching element 223 is connected to the second switching element 222 and the other end thereof is connected to the fourth switching element 224. One end of the fourth switching element 224 is connected to the third switching element 223 and the other end thereof is connected to the negative power terminal.

Also, a DC capacitor 290 connected to both ends of the rectifier 210 may be further included. The DC capacitor 290 serves to reduce ripples in a DC voltage output from the rectifier 210.

The embodiment has been described as an example in which the first heating coil 241 is connected between the first resonant capacitor 261 and the second resonant capacitor 262. However, the first resonant capacitor 261 or the second resonant capacitor 262 may not be provided.

Meanwhile, the embodiment has been described as an example in which the second heating coil 242 is connected to the third resonant capacitor 263 connected with the positive power terminal, and the third heating coil 243 is connected to the fourth resonant capacitor 264 connected with the negative power terminal. However, the second heating coil 242 may be connected to the fourth resonant capacitor 264 connected with the negative power terminal, and the third heating coil 243 may be connected to the third resonant capacitor 263 connected with the positive power terminal.

The second heating coil 242 and the third heating coil 243 may be formed to have the same capacity. The second heating coil 242 and the third heating coil 243 may be simultaneously driven in parallel.

Each of the switching elements 221, 222, 223, and 224 may be connected with an antiparallel diode, and a subsidiary resonant capacitor may be connected in parallel with the antiparallel diode to minimize switching loss of each of the switching elements.

Figure 3:
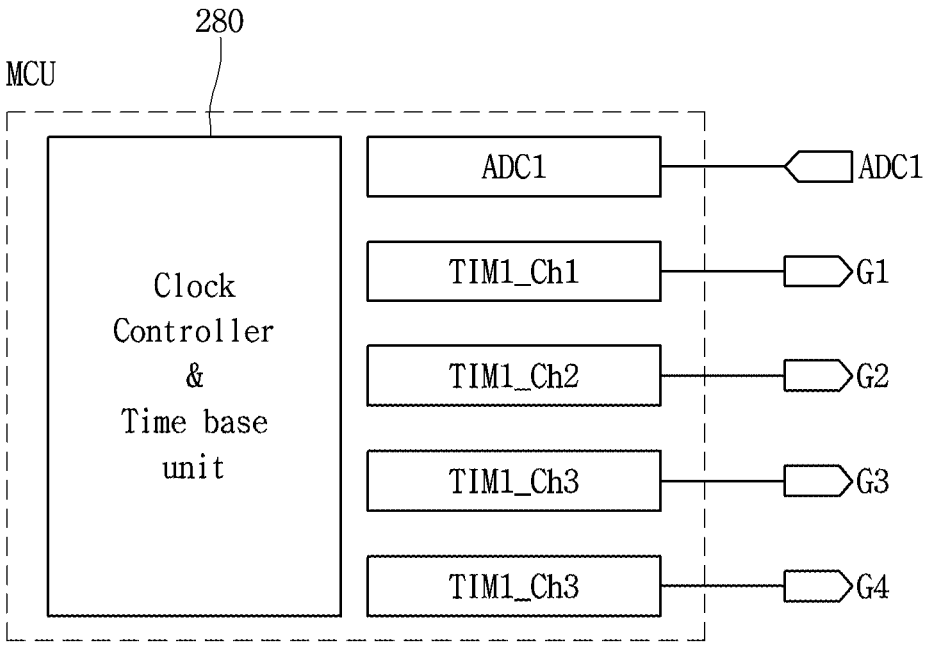
FIG. 3 is a view illustrating a control part which controls a switching element in the embodiment of the present invention.
Figure 4:
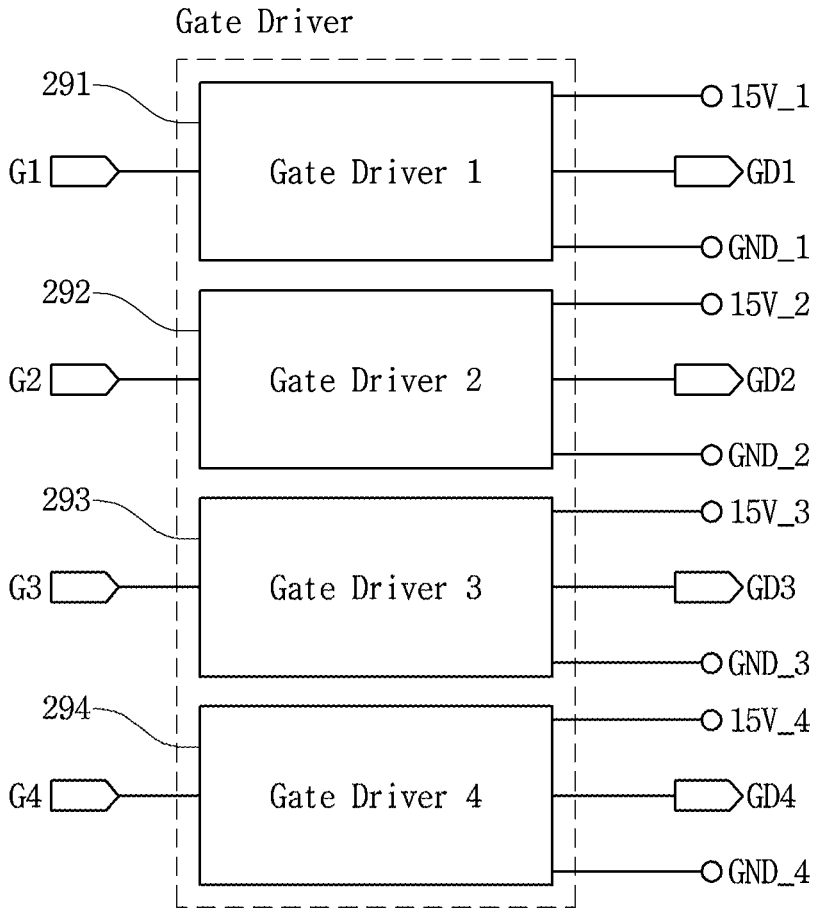
FIG. 4 is a view illustrating a gate driver which operates the switching element in the embodiment of the present invention.
Figure 5:
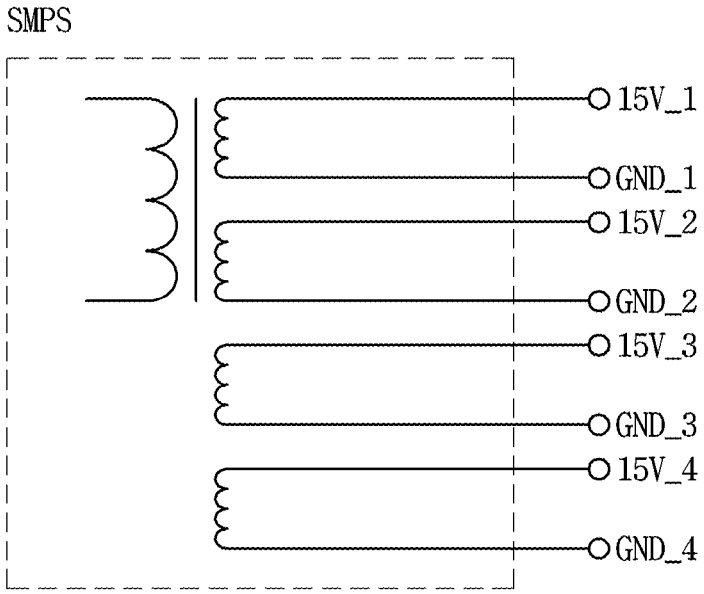
FIG. 5 is a view illustrating a switching mode power supply in the embodiment of the present invention.

FIG. 3 is a view illustrating a control part which controls the switching element according to the embodiment of the present invention, FIG. 4 is a view illustrating a gate driver which operates the switching element according to the embodiment of the present invention, and FIG. 5 is a view illustrating a switching mode power supply (SMPS) according to the embodiment of the present invention.

Referring to FIGS. 3 to 5, a control part 280 is connected to inputs G1, G2, G3 and G4 of first, second, third and fourth gate drivers 291, 292, 293 and 294 which drive the switching elements 221, 222, 223 and 224, and outputs GD1, GD2, GD3 and GD4 of the gate drivers 291, 292, 293 and 294 are connected to gate ends of the switching elements 221, 222, 223 and 224. As illustrated in FIG. 5, separate power of a multi-output SMPS is used as power supplied to the gate drivers 291, 292, 293, and 294.

Therefore, a signal of the control part 280 may be applied to the gate drivers 291, 292, 293, and 294 to drive a semiconductor switch, and thus, each of the switching elements 221, 222, 223, and 224 may be controlled.

Meanwhile, a current converter 270 may be provided between a ground of the switching elements 221, 222, 223, and 224 connected in series and a ground of the first, second, and third heating coils 241, 242, and 243. The current converter 270 measures a current flowing through the first, second, and third heating coils 241, 242, and 243, and enables a current value to be input to the control part 280 via an analog-digital converter (ADC) provided at the control part 280. The control part 280 controls the switching elements 221, 222, 223, and 224 based on the current value.

Figure 6:
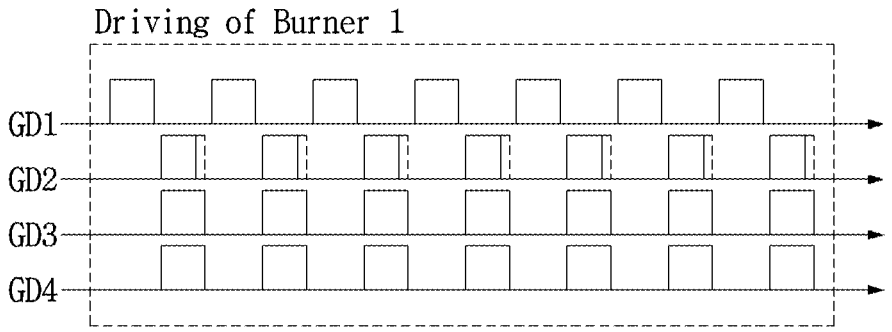
FIGS. 6 to 8 are views illustrating a signal which drives each heating coil in the embodiment of the present invention.
Figure 7:
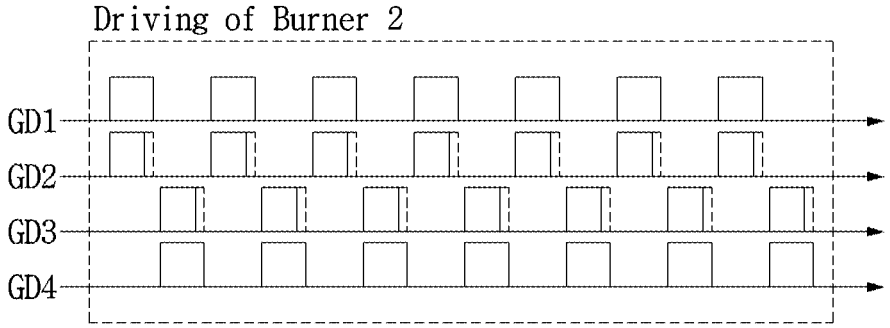
Figure 8:
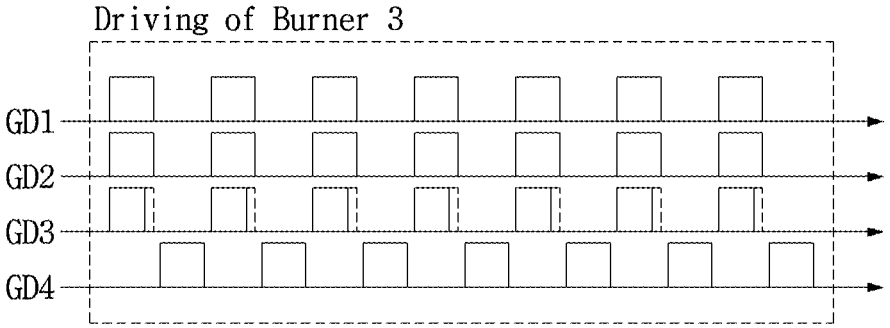

FIGS. 6 to 8 are views illustrating a signal which drives each heating coil (Burner) in the embodiment of the present invention.

Referring to FIGS. 6 to 8, the control part 280 controls the current flowing through the first, second, and third heating coils 241, 242, and 243 by controlling the switching elements 221, 222, 223, and 224.

Referring to FIG. 6, when the control part 280 intends to drive the first heating coil 241, the first switching element 221 is controlled to be in a closed state, and the second, third, and fourth switching elements 222, 223, and 224 are controlled to be in an opened state during half of a resonant period. During the other half of the resonant period, the first switching element 221 is controlled to be in the opened state, and the second, third, and fourth switching elements 222, 223, and 224 are controlled to be in the closed state.

The resonant period is a reciprocal number of a resonant frequency, and the resonant frequency may be determined by reactance and capacitance values of the circuit. The induction heat cooking apparatus of the present invention has a resonant frequency of about 20 to 70 kHz. Therefore, when the resonant frequency is 20 kHz, the resonant period is 5 ms.

During the half of the resonant period, an input voltage is applied to the first heating coil 241 and the first and second resonant capacitors 261 and 262 through the above-described operation, and thus, resonance is started, and a current of the first heating coil 241 is increased. During the other half of the resonant period, the input voltage is reversely applied to the first heating coil 241 and the first and second resonant capacitors 261 and 262, and thus, the resonance is started, and a reverse directional current of the first heating coil 241 is increased.

Meanwhile, in the present invention, when the first heating coil 241 is driven, a leakage current leaking to the second and third heating coils 242 and 243 may be reduced through a method in which a time at which the second switching element 222 of the first switching element 221 and the second switching element 222 connected with the first heating coil 241, which is disposed between the first heating coil 241 and the second heating coil 242, is switched from the closed state to the opened state is earlier than that of the third and fourth switching elements 223 and 224.

The time at which the second switching element 222 is switched to the opened state may be set to about 1 to 1.5 ms earlier, but is not limited thereto.

When the time at which the second switching element 222 is switched to the opened state is earlier, the leakage current flowing through the second heating coil 242 or the third heating coil 243 which is not operated may be reduced. Therefore, unnecessary power consumption and temperature rise may be prevented by reducing the leakage current flowing through the second heating coil 242 or the third heating coil 243.

As such an operation is repeated, an eddy current is induced in a cooking container placed on the first heating coil 241, and thus, the induction heat cooking apparatus is operated.

Referring to FIG. 7, when the control part 280 intends to drive the second heating coil 242, the first switching element 221 and the second switching element 222 are controlled to be in the closed state, and the third and fourth switching elements 223 and 224 are controlled to be in the opened state during the half of the resonant period. During the other half of the resonant period, the first switching element 221 and the second switching element 222 are controlled to be in the opened state, and the third and fourth switching elements 223 and 224 are controlled to be in the closed state.

During the half of the resonant period, the input voltage is applied to the second heating coil 242 and the third resonant capacitor 263 through the above-described operation, and thus the resonance is started, and a current of the second heating coil 242 is increased. During the other half of the resonant period, the input voltage is reversely applied to the second heating coil 242 and the third resonant capacitor 263, and thus the resonance is started, and a reverse directional current of the second heating coil 242 is increased.

Meanwhile, in the present invention, when the second heating coil 242 is driven, the leakage current leaking to the first heating coil 241 or the third heating coil 243 may be reduced through a method in which a time at which the second switching element 222 and the third switching element 223 connected with the second heating coil 242 is switched from the closed state to the opened state is earlier than that of the first switching element 221 or the fourth switching element 224.

When the time at which the second switching element 222 and the third switching element 223 are switched to the opened state is earlier, the leakage current flowing through the first heating coil 241 or the third heating coil 243 which is not operated may be reduced. Therefore, the unnecessary power consumption and temperature rise may be prevented by reducing the leakage current flowing through the first heating coil 241 or the third heating coil 243.

As such an operation is repeated, an eddy current is induced in the cooking container placed on the second heating coil 242, and thus, the induction heat cooking apparatus is operated.

Referring to FIG. 8, when it is intended to drive the third heating coil 243, the first, second, and third switching elements 221, 222, and 223 are controlled to be in the closed state, and the fourth switching element 224 is controlled to be in the opened state during the half of the resonant period. During the other half of the resonant period, the first, second, and third switching elements 221, 222, and 223 are controlled to be in the opened state, and the fourth switching element 224 is controlled to be in the closed state.

During the half of the resonant period, the input voltage is applied to the third heating coil 243 and the fourth resonant capacitor 264 through the above-described operation, and thus, the resonance is started, and a current of the third heating coil 243 is increased. During the other half of the resonant period, the input voltage is reversely applied to the third heating coil 243 and the fourth resonant capacitor 264, and thus the resonance is started, and a reverse directional current of the third heating coil 243 is increased.

Meanwhile, in the present invention, when the third heating coil 243 is driven, the leakage current leaking to the first heating coil 241 or the second heating coil 242 may be reduced through a method in which a time at which the third switching element 223 of the third switching element 223 and the fourth switching element 224 connected with the third heating coil 243, which is disposed between the second heating coil 242 and the third heating coil 243, is switched from the closed state to the opened state is earlier.

When the time at which the third switching element 223 is switched to the opened state is earlier, the leakage current flowing through the first heating coil 241 or the second heating coil 242 which is not operated may be reduced. Therefore, the unnecessary power consumption and temperature rise may be prevented by reducing the leakage current flowing through the first heating coil 241 or the second heating coil 242.

As such an operation is repeated, an eddy current is induced in a cooking container placed on the third heating coil 243, and thus the induction heat cooking apparatus is operated.

Meanwhile, when one of the plurality of heating coils is operated, the control part 280 controls the remaining heating coils not to be operated. Therefore, when a user intends to simultaneously operates the plurality of heating coils, the control part 280 may simultaneously increase a temperature of each of the plurality of heating coils by alternately operating the heating coils which are intended to be simultaneously operated for short periods.

As described above, since the induction heat cooking apparatus according to the embodiment has the plurality of heating coils and the minimum switching elements for driving the plurality of heating coils, it is possible to reduce a size of the induction heat cooking apparatus and also to reduce a manufacturing cost.

Also, to prevent the leakage current from flowing to the heating coil to be operated and the adjacent heating coil, the induction heat cooking apparatus according to the embodiment may reduce the leakage current through a method in which the time at which the switching element disposed between the heating coil to be operated and the adjacent heating coil is switching to the opened state is earlier.

Figure 9:
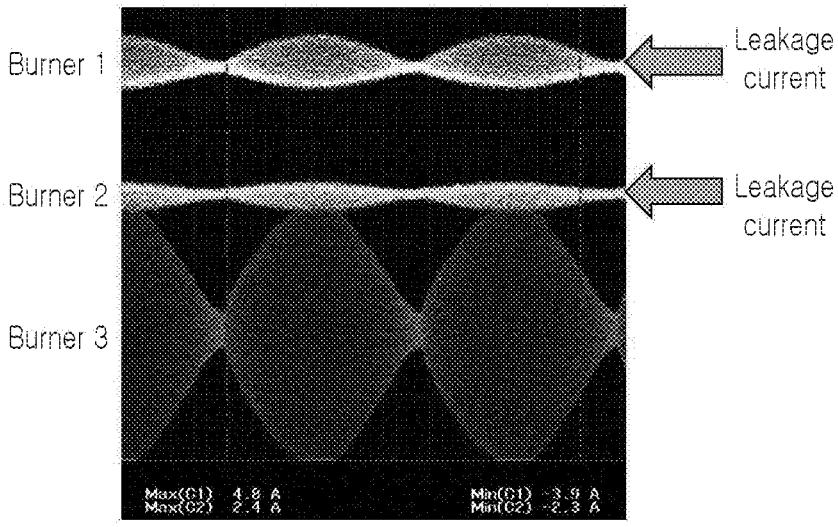
FIGS. 9 and 10 are views illustrating a leakage current when a time at which the switching element is opened in the related art is not earlier, and a leakage current when a time at which the switching element is opened in the embodiment of the present invention is earlier.
Figure 10:
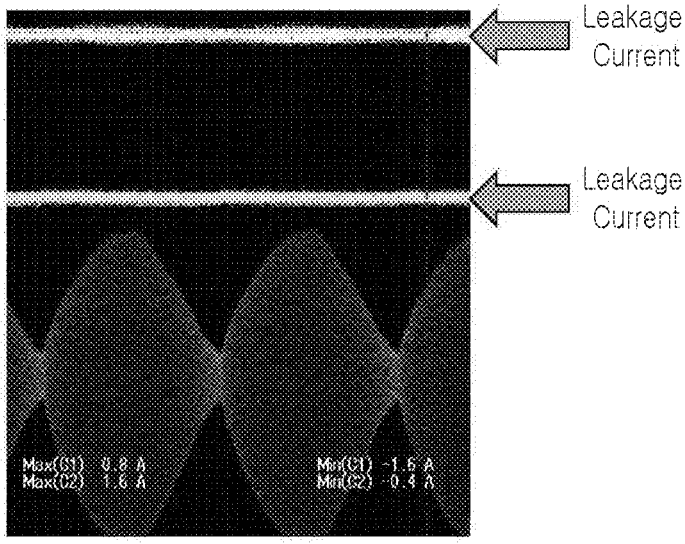

FIGS. 9 and 10 are views illustrating the leakage current when the time at which the switching element in the related art is not opened earlier, and the leakage current when the time at which the switching element in the embodiment of the present invention is opened earlier.

Referring to FIG. 9, when the third heating coil 243 is intended to be driven, if the time at which the third switching element 223, as illustrated in FIG. 8, is opened is the same as that of the first and second switching elements 221 and 222, the leakage current flows to the first heating coil 241 indicated by Burner 1 and the second heating coil 242 indicated by Burner 2.

However, referring to FIG. 10, when the third heating coil 243 is intended to be driven, if the time at which the third switching element 223 is opened, as illustrated in FIG. 8, is earlier than that of the first and second switching elements 221 and 222, the leakage current flowing to the first heating coil 241 indicated by Burner 1 and the second heating coil 242 indicated by Burner 2 is reduced.

According to the present invention, comparing FIG. 9 with FIG. 10, the leakage current flowing to the first heating coil 241 indicated by Burner 1 and the second heating coil 242 indicated by Burner 2 may be reduced, and because a maximum value of the leakage current flowing to the first heating coil 241 and the second heating coil 242 is proportional to the power applied to the first heating coil 241 and the second heating coil 242, the unnecessary temperature rise may be prevented.

Embodiments of the present invention can provide the induction heat cooking apparatus having the plurality of heating coils, which is able to be controlled by the minimum number of switching elements, and the method for controlling the same.

Also, embodiments of the present invention can provide the induction heat cooking apparatus having the plurality of heating coils, in which the plurality of heating coils are able to be driven together by the minimum number of switching elements, and the method for controlling the same.

Also, embodiments of the present invention can provide the induction heat cooking apparatus which can reduce the leakage current generated when the switching element is closed (turned on) or opened (turned off), and thus can reduce the heat from the heating coil which is not operated, and the method for controlling the same.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heat cooking apparatus comprising:

a rectifier to rectify an input voltage and to output a DC voltage;

a plurality of switching elements to switch the DC voltage output from the rectifier;

a plurality of heating coils to perform heating according to an operation of the plurality of switching elements; and a control part to control the plurality of switching elements by sending signals to each of a plurality of gate drivers, wherein the plurality of heating coils comprise a first heating coil, a second heating coil, and a third heating coil, each heating coil being connected to a respective first resonant capacitor, a second resonant capacitor, and a third resonant capacitor in a circuit, wherein the plurality of switching elements comprise a first switching element, a second switching element, a third switching element, and a fourth switching element, and wherein the first heating coil is connected between the first switching element and the second switching element, and the second heating coil is connected between the second switching element and the third switching element, and the third heating coil is connected between the third switching element and the fourth switching element, wherein, when the first heating coil is operated, the control part controls the first switching element to be in the closed state, and controls the second, the third, and the fourth switching elements to be in the opened state during a first half of a resonant period, wherein the control part controls the first switching element to be in the opened state, and controls the second, the third, and the fourth switching elements to be in the closed state during a second half of the resonant period, wherein a closing time of the second switching element between the first heating coil which is operated and the second heating coil which is not operated is the same as a closing time of the third switching element and the fourth switching element, wherein the control part controls a time at which the second switching element between the first heating coil which is operated and the second heating coil which is not operated is opened to be earlier than that of the third switching element and the fourth switching element, such that power is not applied to the second heating coil which is not operated wherein a capacitance value of the circuit determines the resonant period, for which the control part determines the starting time by initiating an input voltage applied to the first heating coil and to the first and second resonant capacitors.

2. The apparatus according to claim 1, wherein the control part controls a closed state of the one switching element to be shorter than half of a resonant period, and also controls each of the other switching elements to be in an opened state or a closed state during half of the resonant period.

3. The apparatus according to claim 1, wherein, when the second heating coil is operated, the control part controls the first and the second switching elements to be in the closed state, and controls the third and the fourth switching elements to be in the opened state during a first half of a resonant period, and also controls the first and the second switching elements to be in the opened state, and controls the third and the fourth switching elements to be in the closed state during a second half of the resonant period, and wherein the control part controls a time at which the second and the third switching elements are opened to be earlier than that of the first and the fourth switching elements.

4. The apparatus according to claim 1, wherein, when the third heating coil is operated, the control part controls the first, the second, and the third switching elements to be in the closed state, and controls the fourth switching element to be in the opened state during a first half of a resonant period, and also controls the first, the second, and the third switching elements to be in the opened state, and controls the fourth switching element to be in the closed state during a second half of the resonant period, and wherein the control part controls a time at which the third switching element is opened to be earlier than that of the first and the second switching elements.

5. The apparatus according to claim 1, wherein, when one of the plurality of heating coils is operated, the control part controls the other of the plurality of heating coils not to be operated.

6. The apparatus according to claim 1, wherein the control part controls a time at which the first switching element between the heating coil which is operated and the heating coil which is not operated is switched from a closed state to an opened state to be 1 to 1.5 ms earlier than that of another of the plurality of switching elements.

* * * * *